United States Patent [19]

Siebenhofer et al.

[11] 4,299,517

[45] Nov. 10, 1981

[54] MINE ROOF SUPPORTING STRUCTURE

[75] Inventors: Gottfried Siebenhofer, Vienna; Heinrich Suessenbeck; Alfred Zitz, both of Zeltweg, all of Austria

[73] Assignee: Voest-Alpine Aktiengesellschaft, Vienna, Austria

[21] Appl. No.: 114,599

[22] Filed: Jan. 23, 1980

[30] Foreign Application Priority Data

Feb. 14, 1979 [AT] Austria ..... 1134/79

[51] Int. Cl.[3] ..... E21D 15/44

[52] U.S. Cl. ..... 405/296; 91/170 MP

[58] Field of Search ..... 405/291, 295, 296, 302; 91/170 MP

[56] References Cited

U.S. PATENT DOCUMENTS

| | | | |
|---|---|---|---|
| 3,898,845 | 8/1975 | Plevak et al. | 405/296 |
| 3,915,500 | 10/1975 | Schlusener et al. | 405/296 X |
| 4,020,640 | 5/1977 | Sigott et al. | 405/296 X |
| 4,037,419 | 7/1977 | Hill et al. | 405/296 X |

FOREIGN PATENT DOCUMENTS

| | | | |
|---|---|---|---|
| 832741 | 1/1970 | Canada | 405/302 |
| 2603276 | 4/1977 | Fed. Rep. of Germany | 405/296 |

*Primary Examiner*—Ernest R. Purser

*Attorney, Agent, or Firm*—Cushman, Darby & Cushman

[57] ABSTRACT

The mine roof supporting structure comprises hydraulic props (3) which are pressing a swivelling cap (8) against the mine roof. A link lever (5) is pivotally linked to the floor frame (1) and a shield (4) is pivotally linked to the link lever (5) and to the cap (8). The shield (4) is pulled in direction to the floor frame (1) by means of a hydraulic tension strut (14). The working chamber (24) of the tension strut (16), which working chamber includes the piston rod and is facing the pivotal point (12) of the tension strut (16) to the shield (4), can be brought in connection with the supply conduit (19) for feeding pressurized fluid to the props (3) via a spring loaded check valve (22, 23), noting that the opening pressure of the spring (22) is smaller than the final supporting pressure exerted by the props (3). The piston surface of the working chamber (24) is smaller than the piston surface (4) delimiting the working chamber of the props (3). A change-over valve (25) is provided for connecting in one position the supply conduit (19) and in the other position a separate conduit (28) for pressurized fluid with the hydraulic tensions strut (14), noting that in the other position the connection between the conduit for pressurized fluid and the working chamber (21) of the props is closed (FIG. 3).

6 Claims, 5 Drawing Figures

MINE ROOF SUPPORTING STRUCTURE

The present invention refers to a mine roof supporting structure for consolidating mines, comprising at least one cap supported against a floor frame by hydraulic props, a shield being linked to said cap and connected with the floor frame by at least one link lever linked to the floor frame such that the pivotal point of the shield is with downward movement of the mine roof supporting structure moved in backward direction in direction to the old excavation or old man, noting that the cap is protruding over the foreward end of the floor frame directed to the mine face and to the conveyor means located there and that the pivotal point of the shield to the link lever can be forced in direction to the foreward end of the floor frame by means of a hydraulic cylinder-piston-arrangement resting on the floor frame. Such mine roof supporting structures are known and commonly used and have the cap protruding over the foreward end of the floor frame facing the mine face because the floor frame must keep free a space for the conveyor means arranged at the mine face and because this conveyor means shall be protected by the cap. It is already known to position the front cap in any height position of the mine roof supporting structure by forcing the link lever, to which the shield is linked, in direction to the front end of the floor frame by means of a hydraulic cylinder-piston-arrangement. Such constructions only serve the purpose for guiding the front cap and, above all, to maintain the front end of the front cap at a constant small distance from the mine face irrespective of different height positions of the mine roof supporting structure. For this reason, the cylinder-piston-arrangement required for such adjusting movement was of weak design in said known constructions. In view of the cap protruding in direction to the mine face, the front end of the floor frame is, however, subjected to substantially higher load than its rear end. This has as a result that, particularly with weak mine sill, the front end will sink into the mine sill. The mine roof supporting structure will thus tilt in direction to the mine face and the stability of this structure will be reduced.

The present invention now aims at increasing the stability of a mine roof supporting structure of the kind mentioned and essentially consists in that the hydraulic cylinder-piston-arrangement acting on the pivotal point of the shield to the link lever can be pressurized only after having attained a predetermined supporting pressure of the props which supporting pressure is smaller than the final supporting pressure. In this manner it is reliably achieved that an acting force is introduced into the mine roof supporting structure which pulls the front end of the floor frame in upward direction and subjects the rear end of this floor frame to a heavier load via the shield and the link lever. The front end of the floor frame becomes thus partially relieved and the load center of the floor frame is shifted in backward direction in direction to the old excavation or old man. The stability of the mine roof supporting structure becomes thus increased and even in case of a soft mine sill, sinking in of the front end of the floor frame into the mine sill and the tendency of the mine roof supporting structure to tilt in direction to the mine face is counteracted. The hydraulic cylinder-piston-arrangement, by means of which the pivotal point between shield and link lever is fixed in position relative to the floor frame, is according to an advantageous embodiment designed as a tension strut in which the working chamber located at that side of the piston which carries the piston rod (in which the piston rod chamber of the piston) is supplied with pressurizing fluid after having pressurized the props. In this case, the lever system formed of shield and link lever, which is acting like a toggle-joint, is pulled in direction to its stretched position, whereby the load acting on the linking point between link lever and floor frame is increased and the front end of the floor frame is pulled in upward direction.

According to the invention, the arrangement is conveniently such that the hydraulic cylinder-piston-arrangement acting on the pivotal point between shield and link lever is supplied with pressurizing fluid only after having attained a predetermined supporting pressure in the props which approximately amounts to 20% of the final supporting pressure. This has as a result that an equalization in load becomes effective only after the mine roof supporting structure already exerting a certain supporting force and being maintained in position. Furthermore, the arrangement according to the invention is preferably such that the tension force of the hydraulic cylinder-piston-arrangement acting on the pivotal connection between shield and link lever is smaller than the sum of the supporting forces exerted by the props and is preferably approximately 30% of the sum of these supporting forces. In this manner, the tension force acting on the pivotal connection between shield and link lever serves to a vast extent for equalizing the load of the floor frame whereas the main supporting forces are exerted by the props.

According to a preferred embodiment, in which the hydraulic cylinder-piston-arrangement is formed of a tension strut, the arrangement is preferably such that the working chamber including the piston rod of the hydraulic piston-cylinder-arrangement forming the tension strut is connected with the supply conduit for pressurizing fluid leading to the props via a spring-loaded check valve, the spring of which is preloaded to an opening pressure corresponding to the predetermined supporting pressure of the props being smaller than the final supporting pressure of the props, and that the piston surface delimiting the working chamber including the piston rod of the hydraulic piston-cylinder-arrangement is smaller than the surfaces of the pistons of the props which delimit the working chamber of the props. By correspondingly prestressing the spring of the check valve, the tension strut will thus be made effective only when the props exert part of its supporting force and thus when the mine roof supporting structure is held in position. By giving the piston surface of the hydraulic tension strut, which is subjected to the action of the pressurized fluid, the mentioned dimension in relation to the piston surfaces of the props, the force acting on the pivotal point between shield and link lever is brought into the proper relation to the supporting force exerted by the props.

The invention is further explained with reference to the drawing showing embodiments of the structure according to the invention.

IN THE DRAWING

Figure 1:
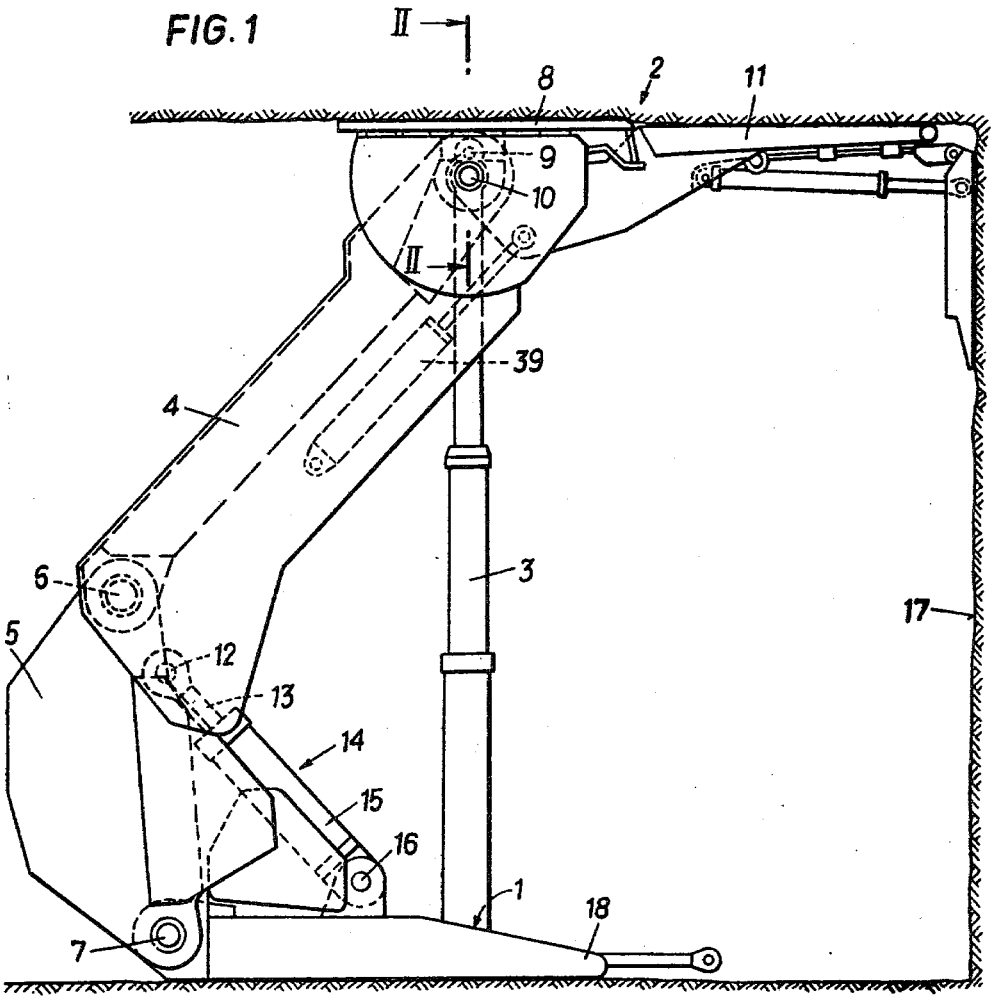
FIG. 1 shows a side elevation of a mine roof supporting structure.
Figure 3:
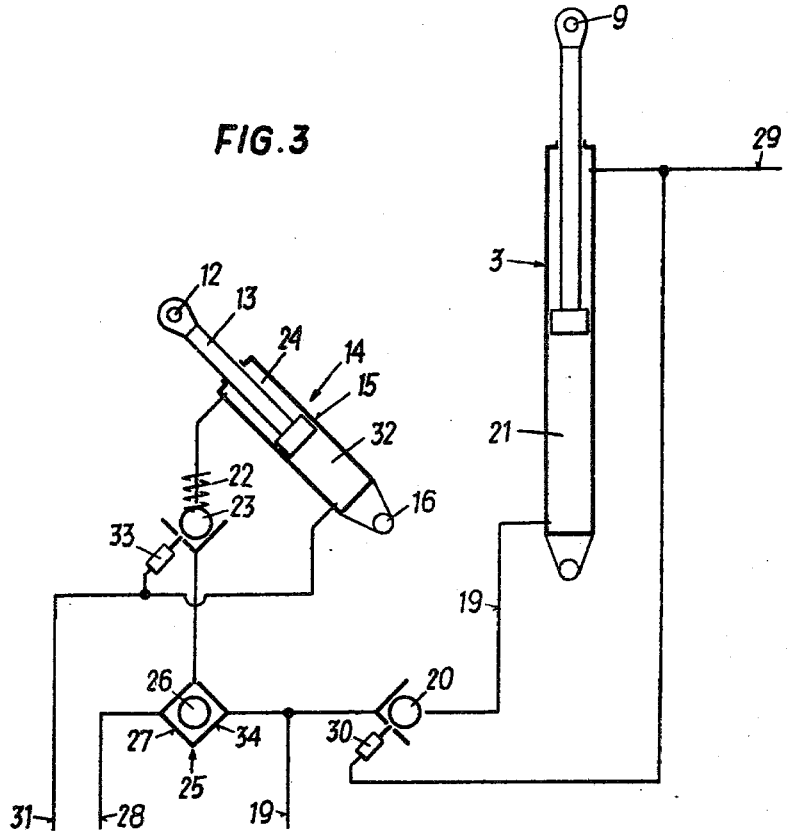
Figure 4:
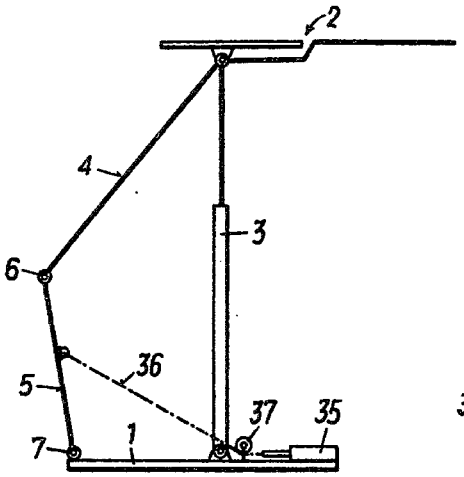
Figure 5:
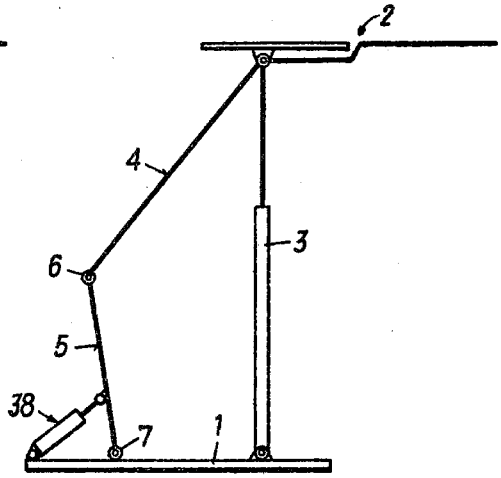

FIG. 3 schematically shows the hydraulic piston-cylinder-arrangements in a prop according to FIG. 1 and FIGS. 4 and 5 show modified embodiments, noting that the mine roof supporting structure, which corresponds in its essence to the arrangement shown in FIG. 1, is outlined in straight lines only.

Figure 2:
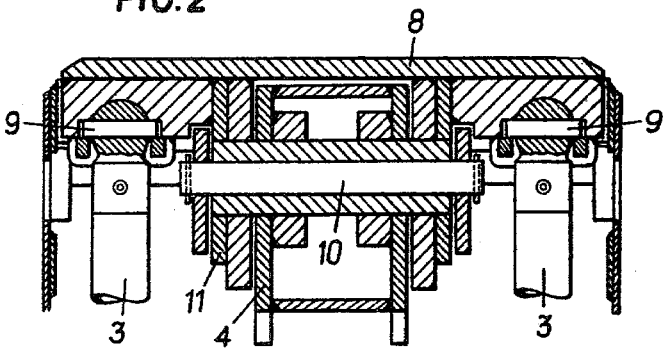
FIG. 2 shows a detail in a section along line II—II of FIG. 1.

In the arrangement according to FIGS. 1 and 2, 1 is the floor frame and 2 is the cap which is supported against the floor frame 1 by two hydraulic props 3. A shield 4 is linked to the cap 2 and further linked to the floor frame 1 at a pivotal point 7 with interposition of a link lever 5 linked to the shield at 6. The cap 2 is formed of a swivelling cap 8 which is (compare FIG. 2) supported by the props 3, noting that the linking point between the props 3 and the swivelling cap 8 is designated 9. A cap 11 and the shield 4 is pivotally linked to this swivelling cap 8 by means of a pivotal bolt 10.

The piston rod 13 of a hydraulic tension strut 14 is pivotally linked to the shield 4 at 12, the cylinder 15 of this strut being pivotally linked to a pivotal point 16 which is located at a distance of the pivotal point 7 between link lever 5 and floor frame 1 at a smaller distance from the mine face 17.

The hydraulic strut 14 is acting via the shield 4 on the pivotal point 6 between shield 4 and link lever 5 and is pulling this linking point 6 in direction to the floor frame, so that the front end 18 of the floor frame 1 facing the mine face is partially relieved from load and the load acting on the pivotal point 7 facing the old excavation or old man becomes increased via the shield and the link lever 5.

In FIG. 3 the hydraulic piston-cylinder-arrangements are schematically illustrated. The supply conduit 19 for pressurizing fluid is connected with a working chamber 21 of the props 3 via a check valve 20. Furthermore, this supply conduit is connected via a check valve 23 loaded with a pretensioned spring 22 with the piston rod chamber 24 of the hydraulic tension strut 14. 25 is a change-over valve comprising a ball 26 which on pressure existing in the supply conduit 19 is closing a valve seat 27 leading to a conduit 28. On account of the spring 22, the check valve 23 gives a response only after having attained a predetermined supporting pressure. In view of the check valve 20, the props 3 are maintained in position even with no pressure in the supply conduit 19 and in view of the check valve 23 also the hydraulic tension strut 14 is maintained in its position so that after having supplied pressurizing fluid the props 3 and the tension struts 14 are independently one from the other maintained in their positions.

When collapsing the mine roof supporting structure, the piston rod chambers of the props 3 are subjected to pressure via a conduit 29, which when setting the props was connected to the discharge conduit for pressurizing fluid, noting that the closing member of the check valve 20 is lifted off its seat by means of a device 30 subjected by the pressure prevailing in a conduit 29, and, in addition, the piston chamber 32 of the tension strut 14 is subjected to pressure via a conduit 31 previously connected to the discharge conduit, noting that the closure member of the check valve 23 is lifted off its seat under the action of the pressure now prevailing in the conduit 31 and acting on a device 33 controlling this closure member. The conduit 19 is connected to the discharge conduit in this case.

If it is desired to actuate the tension strut 14 independently from the props, pressurized fluid is supplied via the conduit 28. The bore 26 of the change-over valve 27 will now be moved in right-hand direction and pressed against the wall seat 34 so that the conduit 28 is separated from the conduit 29. In this manner it is possible to increase the tension force acting on the pivotal point 6 without increasing the pressure once built up in the props 3 in case, with the mine roof supporting structure already supporting the mine roof, the floor frame 1 does sink into the mine sill.

In FIGS. 4 and 5 further arrangements are illustrated which allow to pull in foreward direction the pivotal point 6 between shield 4 and link lever 5. In the arrangement shown in FIG. 4, a hydraulic cylinder-piston-arrangement 35 is provided in the floor frame for pulling in right-hand direction the pivotal point 6 by means of a cable 36 connected to the link lever 5 and guided over a roller 37. In the arrangement shown in FIG. 5, a hydraulic cylinder-piston-arrangement 38 is pivotally linked to the floor frame 1 and to the link lever 5 for pressing the link lever 5 in right-hand direction and thus in direction to the mine face 17.

In FIG. 1, a cylinder-piston-arrangement 39 is supporting the roof cap 11 relative to the shield 4. This cap 11 is applied to the mine roof by actuating the hydraulic cylinder-piston-arrangement 39.

What is claimed is:

1. A mine roof support structure for consolidating mines comprising: a floor frame having a front end and a back end, at least one roof-supporting cap protruding over the front end of said floor frame and supported from said floor frame by means of piston-type hydraulic props, a shield linked to said cap and connected to said floor frame by at least one link lever which is pivotally attached to said floor frame and pivotally attached to said shield at a pivot point in a manner such that downward movement of said cap during a roof collapse causes said pivot point to move backward, a hydraulic cylinder-piston arrangement connected between said floor frame and said pivot point for forcing said pivot point forwardly when said arrangement is pressurized from a pressure source; and control means associated with said props and with said cylinder-piston arrangement for supplying a predetermined pressure to said props and for pressurizing said cylinder-piston arrangement after said predetermined pressure has been supplied to said props and for thereafter supplying a higher pressure to said props.

2. A mine roof support structure as in claim 1 wherein said predetermined pressure applied to said props by said control means is approximately 20 percent of said higher, subsequently applied pressure.

3. A mine roof support structure as in claim 1 or 2 wherein the force applied to said pivot point by said cylinder-piston arrangement by operation of said control means is smaller than the sum of the supporting forces exerted by said props.

4. A mine roof support structure as in claim 3 wherein said force applied to said pivot point is approximately 30 percent of said sum of said supporting forces exerted by said props.

5. A mine roof support structure as in claim 1 or 2 including a pressure supply line connected to said props and wherein said control means includes a spring-loaded check valve connected between said pressure supply line and said cylinder-piston arrangement, said valve being biased toward a closed position by the spring and being openable against the bias under the influence of said predetermined pressure which is supplied to said props, and wherein the working surface of the piston in said cylinder-piston arrangement is less than the working surface of pistons of said props.

6. A mine roof support structure as in claim 1 or 2 including first and second pressure supply lines, said first pressure supply line being connected to said props, a change-over valve operable in one position to connect said first pressure supply line with said cylinder-piston arrangement and operable in a second position to connect said cylinder-piston arrangement to said second pressure supply line and to close the connection between said first pressure supply conduit and said props.

* * * * *